US005300857A

United States Patent [19]

Imai et al.

[11] Patent Number: 5,300,857

[45] Date of Patent: Apr. 5, 1994

[54] FLAT IMAGE DISPLAY DEVICE WITH FILAMENTARY CATHODE SUPPORT STRUCTURE

[75] Inventors: Kanji Imai; Seiichi Taniguchi; Mitsunori Katano; Fumio Yamazaki; Toshifumi Nakatani, Osaka, all of Japan

[73] Assignee: Matsushita Electric Industrial Co., Ltd., Osaka, Japan

[21] Appl. No.: 774,818

[22] Filed: Oct. 11, 1991

[30] Foreign Application Priority Data

Oct. 11, 1990 [JP] Japan ..... 2-273974

[51] Int. Cl.[5] ..... H01J 61/02

[52] U.S. Cl. ..... 313/491; 313/269; 313/272; 313/292; 313/302; 313/496; 313/497

[58] Field of Search ..... 313/491, 495, 496, 497, 313/251, 252, 268, 269, 272, 302, 343, 292

[56] References Cited

U.S. PATENT DOCUMENTS 3,780,326 12/1973 Raago ..... 313/272 X
3,846,662 11/1974 Hooker ..... 313/496
4,164,683 8/1979 Nakamura et al. ..... 313/496

FOREIGN PATENT DOCUMENTS 0140060 12/1982 Japan .
0171035 8/1986 Japan ..... 313/302
2-121239 5/1990 Japan .

*Primary Examiner*—Donald J. Yusko
*Assistant Examiner*—Ashok Patel
*Attorney, Agent, or Firm*—Pollock, Vande Sande & Priddy

[57] ABSTRACT

An image display device displays an image based on visible fluorescent radiation caused by electron beams emitted from a plurality of parallel spaced filamentary cathodes that extend over a substrate. A pair of support bars fixed to opposite sides of the substrate has a pair of spaced arrays of through holes defined therein, and supports a pair of spaced arrays of electrically conductive pins extending through through holes, with a plurality of electrically insulating bodies disposed around the electrically conductive pins and fitted in the through holes, respectively. Each of the filamentary cathodes has opposite ends secured to the support member and held against outer circumferential surfaces of one pair of electrically conductive pins of the spaced arrays.

11 Claims, 7 Drawing Sheets

FLAT IMAGE DISPLAY DEVICE WITH FILAMENTARY CATHODE SUPPORT STRUCTURE

BACKGROUND OF THE INVENTION

1. Field of the Invention

The present invention relates to an image display device for displaying an image based on visible fluorescent radiation caused by electron beams emitted from filamentary cathodes, and more particularly to such an image display device having a structure by which the filamentary cathodes are stably supported.

2. Description of the Prior Art

Cathode-ray tubes are a typical example of image display device which displays an image based on visible fluorescent radiation developed by the bombardment of a fluorescent screen by an electron beam. However, the cathode-ray tubes are necessarily long in the direction perpendicular to the fluorescent screen, and do not lend themselves to a thin, flat image display device.

Various flat image display devices have been proposed in the art. One such flat image display device comprises an array of parallel filamentary cathodes serving as a quasi-planar electron source for bombarding a patterned anode fluorescent layer with emitted electrons. According to another flat image display device, electrons emitted from an array of parallel filamentary cathodes are divided by a control electrode into a matrix of electron beams that are modulated and deflected to display an image in a matrix pattern.

Both of the above proposed flat image display devices have filamentary cathodes for emitting electron beams to cause visible fluorescent radiation for displaying an image. The flat image display devices are much thinner than the cathode-ray tubes. The filamentary cathodes held in a planar parallel configuration are required to be positioned highly accurately with respect to each other and also to the anodes and the control electrode for achieving a desired degree of displayed image quality such as image uniformity. To meet such a requirement, efforts have been made to provide a structure for supporting filamentary cathodes with high positional accuracy.

The flat image display device, with the matrix control over the electron beams for the display of an image, is additionally required to insulate the filamentary cathodes from each other so that the filamentary cathodes can be driven independently of each other.

One flat fluorescent image display device is disclosed in Japanese Laid-Open Utility Model Publication No. 57(1982)-140060, for example. FIGS. 9 and 10 of the accompanying drawings fragmentarily show the disclosed flat fluorescent image display device with respect to an arrangement for supporting filamentary cathodes.

As shown in FIGS. 9 and 10, the flat fluorescent image display device has parallel spaced filamentary cathodes 13*a*, 13*b* having ends attached to respective filament supports 14 as by welding. Lead terminals 15 have end portions shaped into a vertical wall 17 having two spaced V-shaped grooves 16 opening upwardly. The filamentary cathodes 13*a*, 13*b* have end portions received respectively in the V-shaped grooves 16 near the filament supports 14. The opposite ends (not shown) of the filamentary cathodes 13*a*, 13*b* are similarly attached and supported in position, so that the filamentary cathodes 13*a*, 13*b* are kept under tension over an array of cathodes 18. With the filamentary cathodes 13*a*, 13*b* received in and extending through the V-shaped grooves 16, the distance between the anodes 18 and the filamentary cathodes 13*a*, 13*b* and the distance between the filamentary cathodes 13*a*, 13*b* are determined by the position and dimensional accuracy of the V-shaped grooves 16 irrespective of the position and dimensional accuracy of the filament supports 14.

However, when the filamentary cathodes 13*a*, 13*b* are longitudinally elongated as they are heated in operation, the filamentary cathodes 13*a*, 13*b* are frictionally displaced in the V-shaped grooves 16. Repeated energization and de-energization of the flat image display device gradually wedge the filamentary cathodes 13*a*, 13*b* into the bottoms of the V-shaped grooves 16, frequently causing the filamentary cathodes 13*a*, 13*b* to be broken under frictional forces.

Since the V-shaped grooves 16 are required to be highly accurate with respect to their position, dimensions, and distances or pitched therebetween, the V-shaped grooves 16 are usually cut one by one in the vertical wall 17. It is highly difficult to attain a desired degree of dimensional accuracy particularly with respect to the depth of the V-shaped grooves 16. The V-shaped grooves 16 cannot easily be machined to desired shape, particularly at their bottom corners, because the tip end of a cutting tool must be sharper than the diameter (which is of about 10 μm) of the filamentary cathodes 13*a*, 13*b*.

Another problem is that the filamentary cathodes 13*a*, 13*b* cannot be insulated from each other. If the vertical wall 17 were made as a separate member of a ceramic material such as alumina for electric insulation, then the cutting tool used to cut the V-shaped grooves 16 would be worn quickly, aggravating the above machining difficulties.

The filamentary cathodes 13*a*, 13*b* are generally made of tungsten so that they can be heated red. When the filamentary cathodes 13*a*, 13*b* of tungsten, as they are heated red, are held in contact with a metallic material containing nickel, the nickel is diffused into the grain boundaries of the tungsten crystal, resulting in a reduction in the mechanical strength of the filamentary cathodes 13*a*, 13*b*. The lead terminals 15 are made of a 42-6 alloy (42% Ni - 6% Cr - Fe) or a 47-6 alloy (47% Ni - 6% Cr - Fe) for desired adhesion to frit and glass and also for desired sealing capability. Therefore, the vertical wall 17, which is part of the lead terminals 15, gives rise to diffusion of nickel from the V-shaped grooves 16 into the filamentary cathodes 13*a*, 13*b*, which tends to be broken due to their reduced mechanical strength.

Japanese Laid-Open Patent Publication No. 2(1990)-121239 discloses a flat image display device in which electrons are divided into a matrix of electron beams by a control electrode. The disclosed flat image display device is shown in FIGS. 11 and 12 of the accompanying drawings. FIGS. 11 and 12 primarily show an arrangement for supporting filamentary cathodes.

As shown in FIGS. 11 and 12, each filamentary cathode 19 has opposite ends attached, as by welding, to fixed seats 20*a*, 20*b*, at least one of which is springy in nature. A back electrode 21 has a pair of electrically insulating supports 22*a*, 22*b* on its respective opposite ends, the insulating supports 22*a*, 22*b* having respective oblique grooves 23 defined therein. The filamentary cathode 19 has opposite ends portions held against surfaces of the respective grooves 23 near the fixed seats 20*a*, 20*b*. Insulating rods 24*a*, 24*b* of circular cross section are placed on the back electrode 21 near the respective ends thereof, with the filamentary cathode 19 extending over and being held against the insulating rods 24*a*, 24*b*. The insulating rods 24*a*, 24*b* are positioned outside of an image display area and inwardly of the insulating supports 22*a*, 22*b*. The filamentary cathode 19, which extends over and is held against the insulating rods 24*a*, 24*b*, is spaced from the back electrode 21 and also from a control electrode 25 positioned above the back electrode 21. The other filamentary cathodes (not shown) are also held against surfaces of other oblique grooves (not shown) defined at spaced intervals in the insulating supports 22*a*, 22*b*. Therefore, the distances between the filamentary cathodes are determined by the spaced intervals or pitches between the oblique grooves defined in the insulating supports 22*a*, 22*b*.

The insulating supports 22*a*, 22*b* by which the filamentary cathodes are insulated from each other are made of a ceramic material such as alumina since the ceramic material does not emit gases in vacuum and is capable of withstanding high temperatures. Therefore, a cutting tool used to cut the oblique grooves 23 in the insulating supports 22*a*, 22*b* is worn quickly. It is highly costly to cut the oblique grooves 23 that are required to be highly accurate in dimensions.

Since the accuracy of the spaced intervals or pitches between the filamentary cathodes 19 is governed by the surfaces of the oblique grooves 23 against which the filamentary cathodes 19 are held, the edges of the surfaces of the oblique grooves, 23 should not be beveled. When the filamentary cathodes 19 are energized and de-energized, they are longitudinally elongated and contracted, and tend to be abraded under frictional forces by the edges of the surfaces of the oblique grooves 23. Accordingly, the filamentary cathodes 19 are also apt to be broken by the abrasive action of the edges of the surfaces of the oblique grooves 23, though less frequently than by the abrasive action of the bottoms of the V-shaped grooves 16 shown in FIGS. 9 and 10.

SUMMARY OF THE INVENTION

It is an object of the present invention to provide an image display device which has a relatively simple structure for keeping filamentary cathodes insulated from each other and spaced at highly accurate intervals or pitches, and also for preventing the filamentary cathodes highly reliably from being broken during repeated energization and de-energization thereof.

Another object of the present invention is to provide an image display device of the type described above which can easily be manufactured.

Still another object of the present invention is to provide an image display device having a plurality of filamentary cathodes that are held against pins that are fixed highly reliably in position.

Yet another object of the present invention is to provide an image display device having a plurality of filamentary cathodes that are held against pins that are prevented from being worn by frictional contact with the filamentary cathodes and also prevented from diffusing a metallic material into the filamentary cathodes.

A further object of the present invention is to provide an image display device of the type described above that can easily be manufactured.

A still further object of the present invention is to provide an image display device having a plurality of filamentary cathodes that are protected from being diffused by nickel.

According to the present invention, there is provided an image display device comprising an array of parallel spaced filamentary cathodes for emitting electrons. A fluorescent screen panel displays an image based on visible fluorescent radiation caused by the electron beams emitted from the filamentary cathodes. A support member has a pair of spaced arrays of through holes defined therein, a pair of spaced areas of electrically conductive pins extending through respective through holes, and a plurality of electrically insulating bodies a disposed around the electrically conductive pins and fitted in respective through holes. Each of the filamentary cathodes has opposite ends secured to the support member and held against outer circumferential surfaces of one pair of electrically conductive pins of the spaced arrays.

The image display device further includes a rectangular substrate having opposite sides, the support member comprising a pair of support bars extending along and fixed to the opposite sides of the substrate, the spaced arrays of through holes being defined respectively in the support bars, the filamentary cathodes extending over the substrate. The electrically insulating bodies comprise sleeves, respectively, the sleeves having flanges on ends thereof, the flanges being placed on a surface of each of the support bars.

The electrically insulating bodies comprise solidified bodies of frit filled between the electrically conductive pins and inner circumferential surfaces of the through holes. Alternatively, the electrically insulating bodies comprise solidified bodies of glass filled between the electrically conductive pins and inner circumferential surfaces of the through holes.

The support bars, the insulating bodies, and the pins are made of materials whose coefficients of thermal expansion are progressively smaller in the order named.

The image display device further includes a plurality of hollow cylindrical members fitted over the pins, respectively, and positioned between the filamentary cathodes and the outer circumferential surfaces of the electrically insulating pins, the hollow cylindrical members being made of a material different from the material of the pins. The material of the hollow cylindrical members is free of nickel.

The image display device further includes a plurality of ceramic layers coated on the pins, respectively, and positioned between the filamentary cathodes and the outer circumferential surfaces of the electrically insulating pins.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
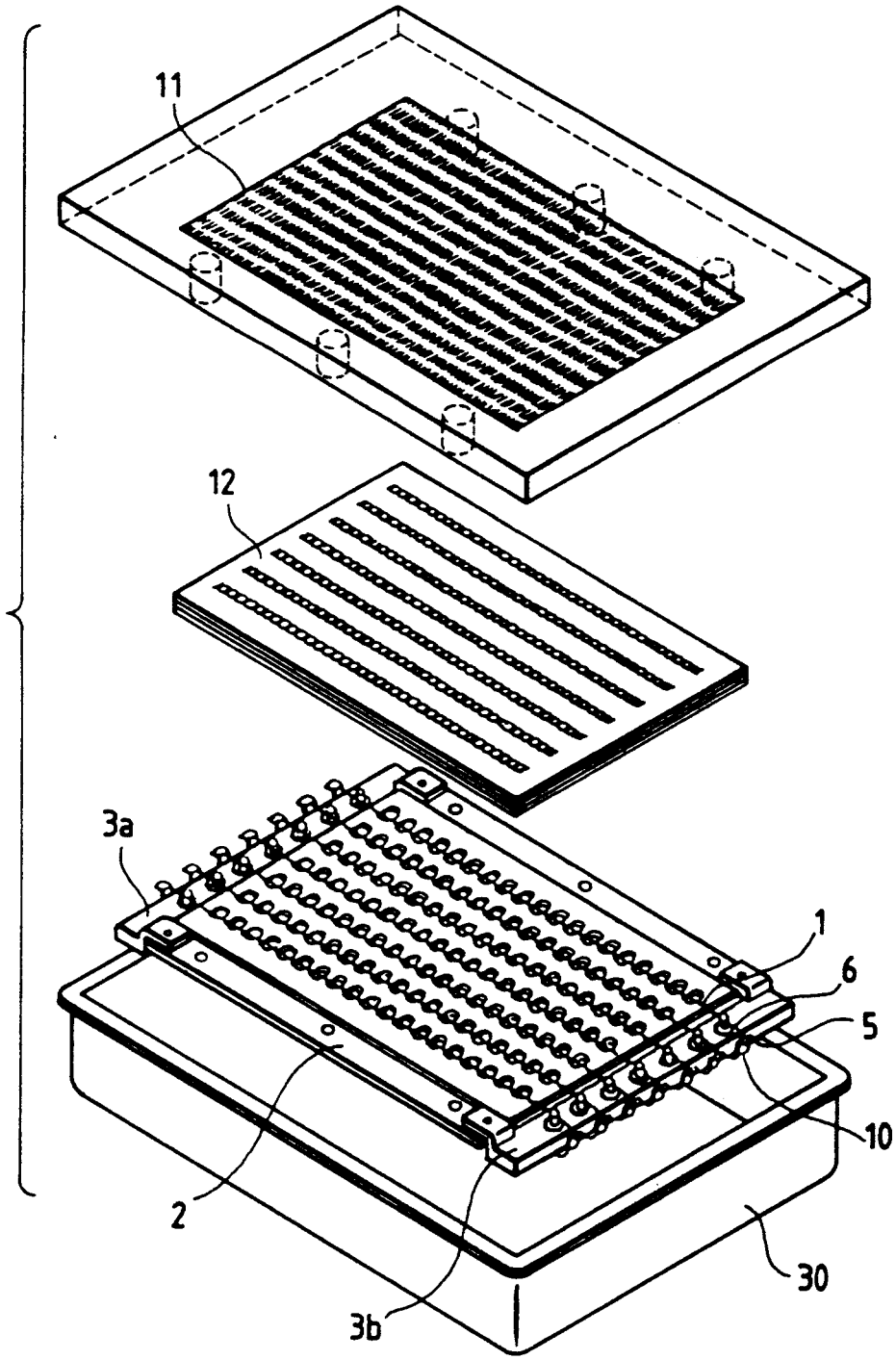
FIG. 1 is an exploded perspective view of an image display device according to a first embodiment of the present invention.

Like or corresponding parts are denoted by like or corresponding reference characters throughout views.

1st Embodiment

Figure 2:
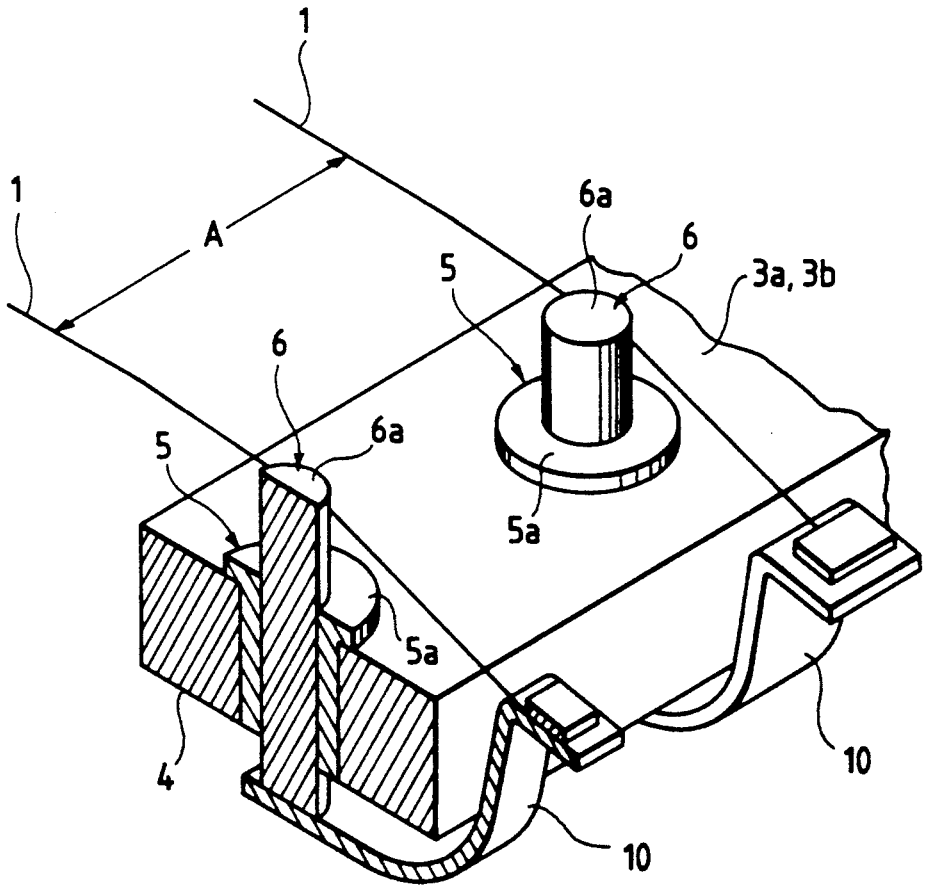
FIG. 2 is an enlarged fragmentary perspective view, partly cut away, of the image display device shown in FIG. 1.

FIGS. 1 and 2 show an image display device according to a first embodiment of the present invention. As shown in FIG. 1, the image display device comprises a rectangular substrate 2, and a pair of support bars 3*a*, 3*b* extending along and fixed to opposite sides of the substrate 2 in abutment thereagainst. The image display device also includes a fluorescent screen panel 11 that is bombarded by an electron beam to develop visible fluorescent radiation, and a control electrode 12 for controlling the electron beam. The substrate 2 with the support bars 3*a*, 3*b* attached thereto, the fluorescent screen panel 11, and the control electrode 12 are combined in a stacked configuration, and placed in a casing 30.

As shown in FIG. 2, each of the support bars 3*a*, 3*b* has an array of through holes 4 defined transversely therein. The through holes 4 of the support bars 3*a*, 3*b* are positioned in aligned pairs. Electrically conductive pins 6 of circular cross section extend respectively through the holes 4 with electrically insulating sleeves 5 disposed around the conductive pins 6 and fitted in the holes 4. The insulating sleeves 5 have flanges 5*a* on upper ends thereof, the flanges 5*a* being held against the upper surface of the support bars 3*a*, 3*b*. The conductive pins 6 have upper end portions 6*a* projecting upwardly above the flanges 5*a*.

The image display device further includes an array of parallel spaced filamentary cathodes 1 extending over the substrate 2 between the support bars 3*a*, 3*b*. More specifically, the filamentary cathodes 1 have opposite ends attached to fixed seats 10 as by welding. The fixed seats 10 are secured to the lower ends of the respective conductive pins 6 and hence positioned in aligned pairs. At least one of the fixed seats 10 in each pair is springy in nature. Each of the fixed seats 10 is of a curved shape having an upper end spaced laterally from the associated pin 6. The opposite ends of each of the filamentary cathodes 1 are securely anchored to the upper ends of the paired fixed seats 10 with the springy seat 10 forcibly biased toward the support bar 3*a* or 3*b* against the resiliency thereof. Therefore, the filamentary cathodes 1 are normally held under tension between the fixed seats 10 in aligned pairs. The filamentary cathodes 1 that extend under tension between the paired fixed seats 10 are held against outer circumferential surfaces of the pins 6 near the upper ends 6*a* thereof.

The image display device shown in FIGS. 1 and 2 operates as follows: When the filamentary cathodes 1 are heated by an electric current flowing therethrough, they emit thermoelectrons. The emitted thermoelectrons are accelerated by the control electrode 12 and divided into a matrix of electron beams that are modulated to represent a desired image. A high voltage is applied to the fluorescent screen panel 11 for accelerating the electron beams. The accelerated electron beams finally bombard the fluorescent screen panel 11 which then produces visible fluorescent radiation with the energy of the electron beams, for thereby displaying the image borne by the electron beams. If any of the filamentary cathodes 1 is displaced off position due to poor positional accuracy, then the displaced image tends to have brightness irregularities or to be distorted. Therefore, it is important that the filamentary cathodes 1 be positioned highly accurately for a desired degree of displayed image quality.

In FIG. 2, the conductive pins 6 are electrically insulated from the support bars 3*a*, 3*b* by the insulating sleeves 5. Therefore, the filamentary cathodes 1 held against the pins 6 are electrically insulated from the support bars 3*a*, 3*b* and hence from each other, so that the filamentary cathodes 1 can be driven independently of each other. The filamentary cathodes 1 are spaced at intervals or pitches A that are determined only by the spacing between the conductive pins 6 against which the filamentary cathodes 1 are held. Since the conductive pins 6 and the insulating sleeves 5 are relatively simple in structure, and yet can attain a high degree of positional accuracy with respect to each other and also to the support bars 3*a*, 3*b*, the filamentary cathodes 1 are spaced highly accurately at the intervals or pitches A. Inasmuch as the filamentary cathodes 1 are positioned highly accurately relative to each other, the brightness of the displayed image is free from irregularities, and the displayed image is prevented from being distorted.

Since the filamentary cathodes 1 are held against outer circumferential surfaces of the conductive pins 6, the filamentary cathodes 1 are curved along arcs about the conductive pins 6. Therefore, even when the filamentary cathodes 1 are elongated and contracted upon energization and de-energization thereof and hence are bubbed against the pins 6, the filamentary cathodes 1 are prevented from biting into the pins 6 and from being abraded by the pins 6. Consequently, the filamentary cathodes 1 are protected form being broken by contact with the pins 6.

The through holes 4 may be defined in the substrate 2 itself, rather than the support bars 3*a*, 3*b*.

2nd Embodiment

Figure 3:
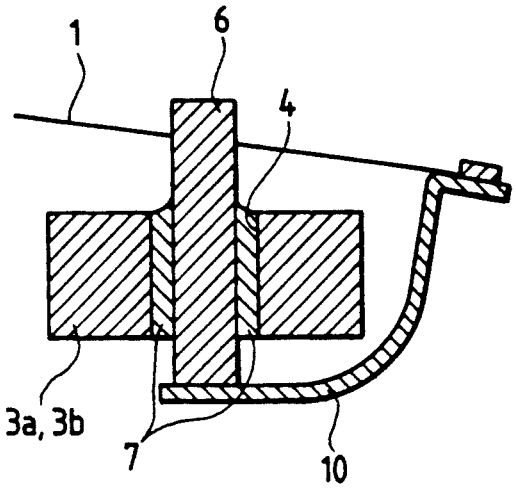
FIG. 3 is a fragmentary cross-sectional view of an image display device according to a second embodiment of the present invention.

FIG. 3 shows in cross-section a portion of an image display device according to a second embodiment of the present invention,. The image display device according to the second embodiment has a substrate, an array of parallel spaced filamentary cathodes, a fluorescent screen panel, a control electrode, and a casing that are essentially identical to those shown in FIG. 1.

In FIG. 3, each of the conductive pins 6 extends through the hole 4 in the support bar 3*a*, 3*b* with an electrically insulating body 7 of frit being filled in an annular space defined between the pin 6 and the inner circumferential surface of the hole 4. Therefore, the pin 6 is fixedly supported in position by the insulating body 7 of frit. The structure shown in FIG. 3 can easily be achieved as follows: First, the conductive pins 6 are supported in an array on a jig (not shown), and then inserted into the respective holes 4 in the support bar 3*a*, 3*b*. Then, the spaces between the pins 6 and the inner circumferential surfaces of the holes 4 are filled with a powder of frit, which is then baked into the solidified insulating body 7. The accuracy of the pitches or intervals between the pins 6 is determined by the dimensional accuracy of the jig for supporting the pins 6. While the insulating body 7 is described as being of frit, it may be made of glass that can be softened or melted at high temperature and thereafter solidified.

3rd Embodiment

Figure 4:
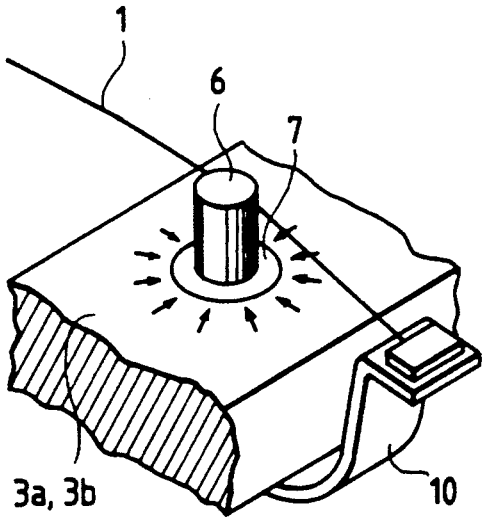
FIG. 4 is a fragmentary perspective view of an image display device according to a third embodiment of the present invention.

FIG. 4 shows in cross section a portion of an image display device according to a third embodiment of the present invention. The image display device according to the third embodiment has a substrate, an array of parallel spaced filamentary cathodes, a fluorescent screen panel, a control electrode, and a casing that are essentially identical to those shown in FIG. 1.

The image display device shown in FIG. 4 is substantially the same as that shown in FIG. 3 except that the coefficients of thermal expansion of the support bar 3*a*, 3*b*, the insulating body 7 of frit, and the pin 6 are progressively smaller in the order named. Specifically, the materials of the support bar 3*a*, 3*b*, the insulating body 7, and the pin 6 are selected such that the coefficient $\alpha$ of thermal expansion of the support bar 3*a*, 3*b*, the coefficient $\beta$ of thermal expansion of the insulating body 7, and the coefficient $\gamma$ of thermal expansion of the pins 6 are of the relationship: $\alpha > \beta > \gamma$. When the powder of frit is baked and then cooled into the insulating body 7, the insulating body 7 of frit undergoes compressive stresses in the directions indicated by the arrows in FIG. 4. Since glass materials are generally weak against tensile stresses but strong against compressive stresses, the insulating body 7 of frit is securely fixed in position, and hence the pin 6 is fixed highly reliably in position. In the image display device shown in FIG. 4, therefore, the pins 6 are positioned with high positional accuracy.

4th Embodiment

Figure 5:
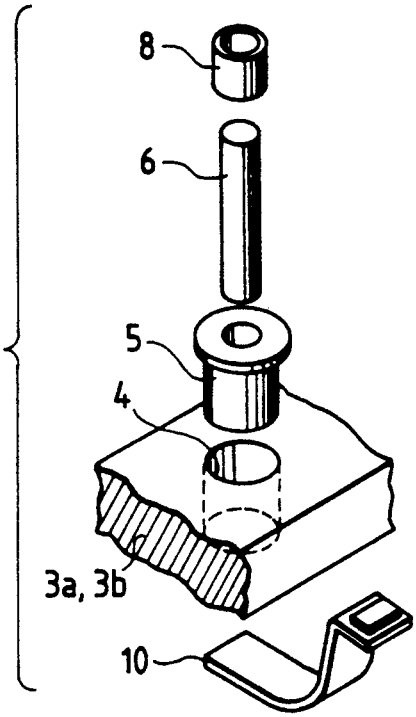
FIG. 5 is a fragmentary exploded perspective view of an image display device according to a fourth embodiment of the present invention.
Figure 6:
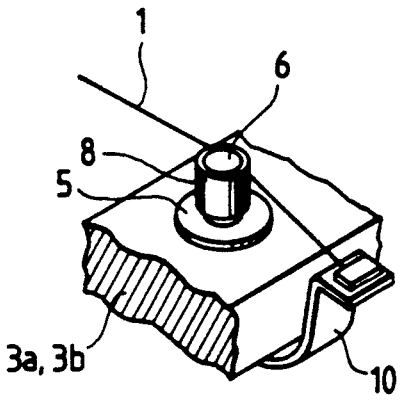
FIG. 6 is a fragmentary perspective view of the image display, shown as assembled, according to the fourth embodiment.

FIGS. 5 and 6 show a portion of an image display device according to a fourth embodiment of the present invention. The image display device according to the fourth embodiment has a substrate, an array of parallel spaced filamentary cathodes, a fluorescent screen panel, a control electrode, and a casing that are essentially identical to those shown in FIG. 1.

The image display device shown in FIG. 5 and 6 is substantially the same as that shown in FIG. 2 except that a hollow cylindrical member 8 is fitted over the upper end portion of each of the pins 6, the hollow cylindrical member 8 being of a material different from the material of the pin 6. For assembly, before the pin 6 is inserted into the hole 4, the hollow cylindrical member 8 is press-fitted over the pin 6. Then, after the parts are assembled as shown in FIG. 6, the filamentary cathode 1 is held against an outer circumferential surface of the hollow cylindrical member 8.

The pin 6 may be made of a soft material such as a 47-6 alloy (47% Ni - 6% Cr - Fe) for good adhesion to glass, which allows a metallic material, particularly nickel, to be diffused into the core of the filamentary cathode 1 when in contact therewith. The hollow cylindrical member 8 is made of a hard material which does not contain any metallic materials that would be diffused into the core of the filamentary cathode 1. Inasmuch as the filamentary cathode 1 is held in contact with the hollow cylindrical member 8, no metallic material is diffused from the pin 6 into the core of the filamentary cathode 1. In addition, the pin 6 is prevented from being worn by direct abrasive contact with the filamentary cathode 1. The pin 6 is therefore positioned very accurately and protected from breakage.

5th Embodiment

Figure 7:
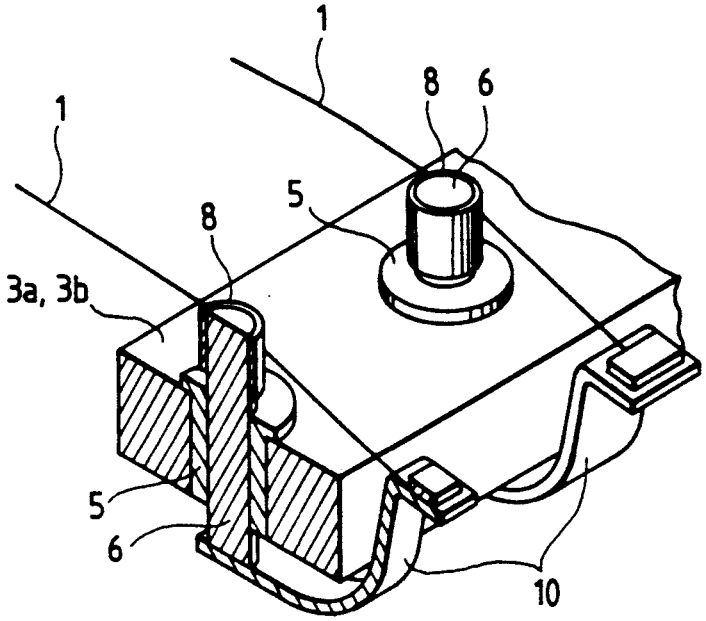
FIG. 7 is a fragmentary perspective view, partly cut away, of an image display device according to a fifth embodiment of the invention.

FIG. 7 shows a portion of an image display device according to a fifth embodiment of the present invention. The image display device according to the fifth embodiment has a substrate, an array of parallel spaced filamentary cathodes, a fluorescent screen panel, a control electrode, and a casing that are essentially identical to those shown in FIG. 1.

The image display device shown in FIG. 7 is substantially the same as that shown in FIGS. 5 and 6, and resides in that the hollow cylindrical member 8 is made of a metallic material that does not contain nickel. If the heated filamentary cathode 1, typically of tungsten, were held in contact with a metallic material containing nickel, then the nickel would be diffused into the grain boundaries of the tungsten crystal of the filamentary cathode 1, thereby lowering the mechanical strength of the filamentary cathode 1. In view of this, the hollow cylindrical member 8 may be made of ferrite stainless steel such as SUS430, for example. Even if the pin 6 is made of a 47-6 alloy, since the pin 6 is held out of contact with the filamentary cathode 1 by the hollow cylindrical member 8, the nickel is prevented from being diffused from the pin 6 into the core of the filamentary cathode 1. Accordingly, the filamentary cathode 1 is prevented from being lowered in the mechanical strength by diffusion of nickel, and hence is protected from breakage.

6th Embodiment

Figure 8:
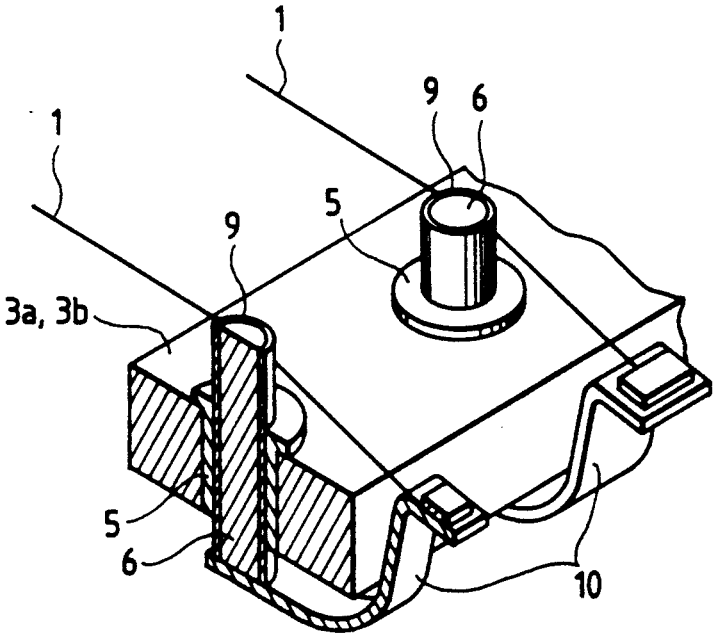
FIG. 8 is a fragmentary perspective view, partly cut away, of an image display device according to a sixth embodiment of the present invention.
Figure 9:
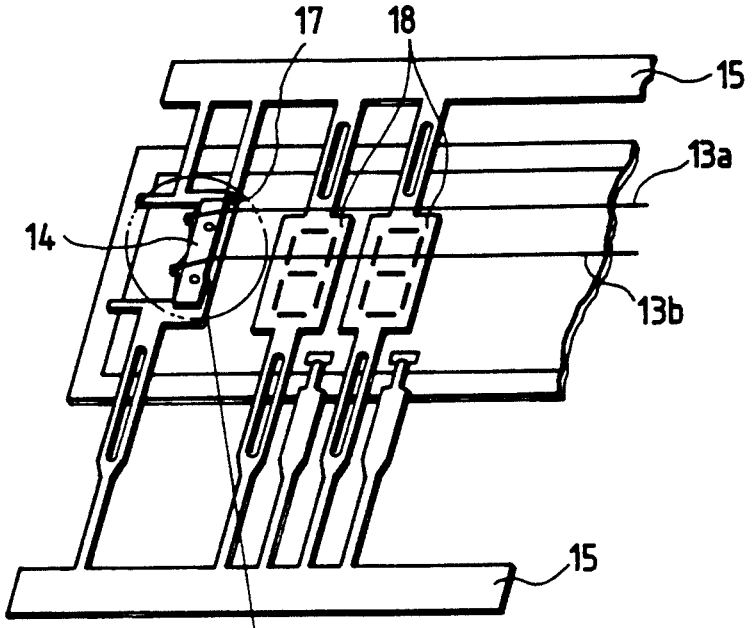
FIG. 9 PRIOR ART
FIG. 9 is a fragmentary perspective view of a conventional image display device.
Figure 10:
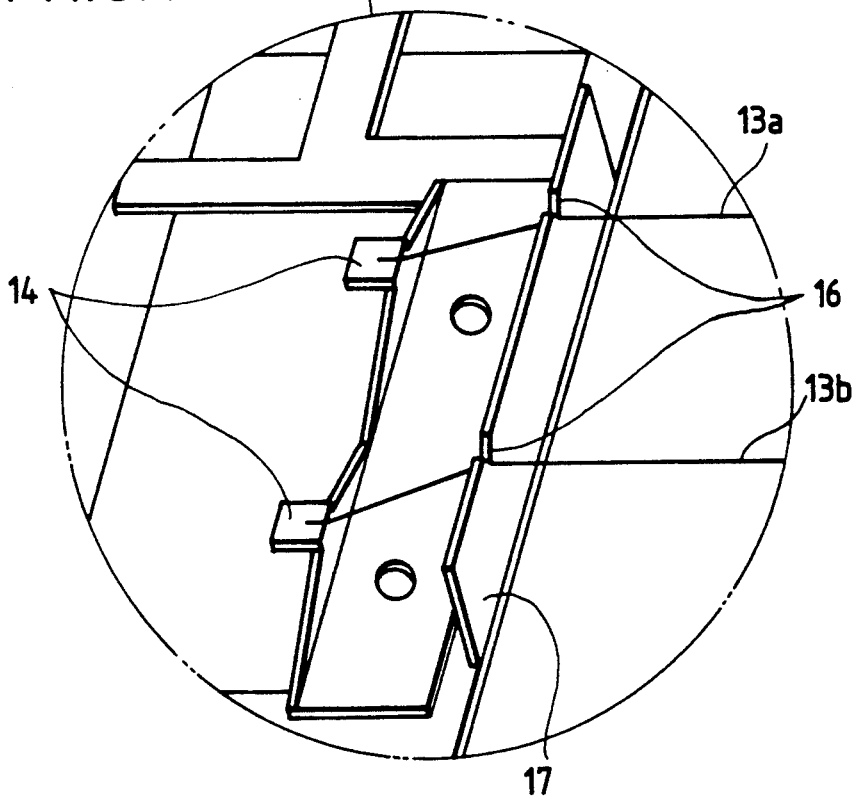
FIG. 10 PRIOR ART
FIG. 10 is an enlarged fragmentary perspective view of an encircled portion of the conventional image display device shown in FIG. 9;.
Figure 11:
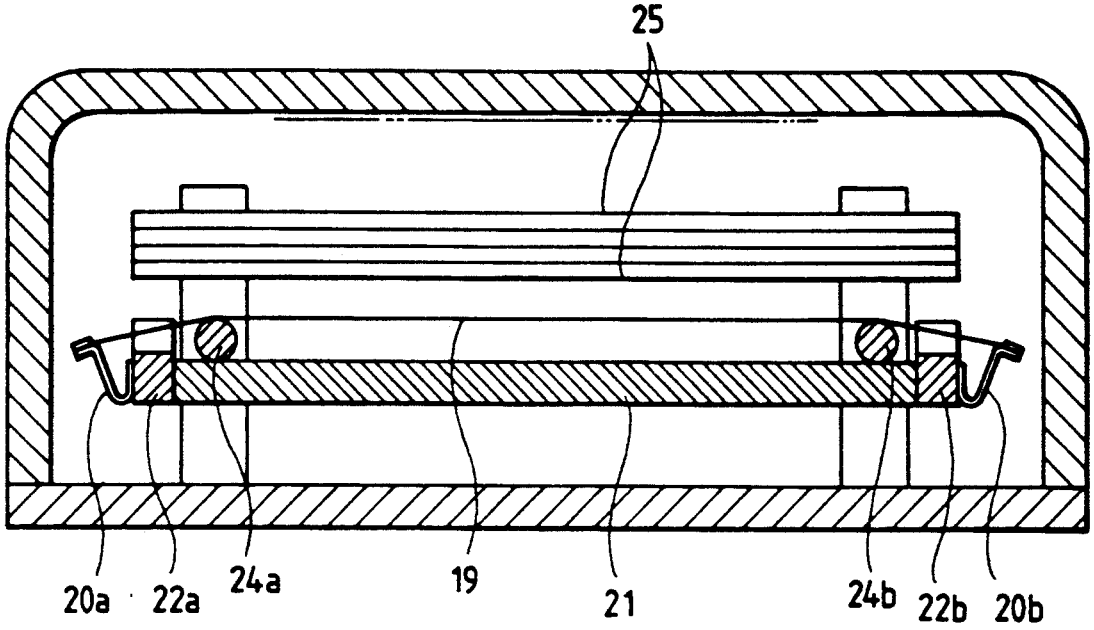
FIG. 11 PRIOR ART
FIG. 11 is a cross-sectional view of another conventional image display device.
Figure 12:
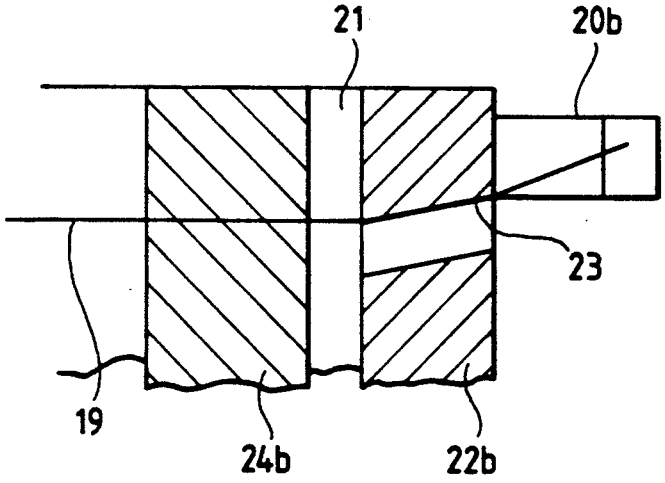
FIG. 12 PRIOR ART
FIG. 12 an enlarged fragmentary plan view of the conventional image display device shown in FIG. 11.

FIG. 8 shows a portion of an image display device according to a sixth embodiment of the present invention. The image display device according to the sixth embodiment has a substrate, an array of parallel spaced filamentary cathodes, a fluorescent screen panel, a control electrode, and a casing that are essentially identical to those shown in FIG. 1.

The image display device shown in FIG. 8 is substantially the same as that shown in FIG. 7 except that instead of the hollow cylindrical member 8, a ceramic layer 9 is coated on the outer circumferential surface of the pin 6 throughout its entire length. The ceramic layer 9 may be coated on the pin 6 as by electrodeposition and baking before the pin 6 is assembled into the support bar. The filamentary cathode 1 is held against the ceramic layer 9 near the upper end of the pin 6, as shown in FIG. 8. As with the fourth and fifth embodiments, even if the pin 6 is made of a 47-6 alloy, since the pin 6 is held out of direct abrasive contact with the filamentary cathode 1 by the ceramic layer 9, and pin 6 is prevented from being worn by the filamentary cathode 1, and the diffusive metal is prevented from being diffused from the pin 6 into the core of the filamentary cathode 1. In addition, since the ceramic layer 9 can easily be coated on the pin 6, the image display device according to the sixth embodiment can be manufactured relatively easily.

Although certain preferred embodiments of the present invention have been shown and described in detail, it should be understood that various changes and modifications may be made therein without departing from the scope of the appended claims.

We claim as our invention:

1. An image display device enclosed within an evacuated envelope, comprising:

an array of parallel spaced filamentary cathodes for emitting electrons;

a fluorescent screen panel for displaying an image based on visible fluorescent radiation caused by the electron beams emitted from said filamentary cathodes;

a rectangular substrate having opposite sides;

a pair of support bars extending along and fixed to said opposite sides of the substrate, each of said support bars having an array of through holes defined therein;

electrically conductive pins extending through said through holes, respectively;

electrically insulating bodies disposed around said electrically conductive pins and fitted in said through holes, respectively; and each of said filamentary cathodes extending over said substrate and having opposite ends secured to said support bars, each of said filamentary cathodes being held against a circumferential surface of a corresponding one of said electrically conductive pins at each of said support bars.

2. An image display device according to claim 1, wherein said electrically insulating bodies comprise sleeves, each of said sleeves having a flange at one end thereof, said flange being placed on a surface of a corresponding one of said support bars, said surface confronting said screen panel.

3. An image display device according to claim 1, wherein said electrically insulating bodies comprise solidified bodies of frit filled between said electrically conductive pins and inner circumferential surfaces of said through holes.

4. An image display device according to claim 1, wherein said electrically insulating bodies comprise solidified bodies of glass filled between said electrically conductive pins and inner circumferential surfaces of said through holes.

5. An image display device according to claim 1, wherein said support bars, said insulating bodies, and said pins are made of materials whose coefficients of thermal expansion are progressively smaller in the order named.

6. An image display device according to claim 1, further including a plurality of hollow cylindrical members fitted over said pins, respectively, and positioned between said filamentary cathods and said circumferential surfaces of said electrically conductive pins, said hollow cylindrical members being made of a material different from the material of said pins.

7. An image display device according to claim 6, wherein said material of the hollow cylindrical members is free of nickel.

8. An image display device according to claim 1, further including a plurality of ceramic layers coated on said pins, respectively, and positioned between said filamentary cathods and said circumferential surfaces of said electrically conductive pins.

9. An image display device enclosed within an evacuated envelope, comprising;

an array of parallel spaced filamentary cathods for emitting electrons;

a fluorescent screen panel for displaying an image based on visible fluorescent radiation caused by the electron beams emitted from said filamentary cathods;

a substrate having opposite end portions each of which is provided with means for mounting an array of positioning pins; and each of said filamentary cathods fixedly extending over said substrate ena being held against a corresponding one of said positioning pins at each of said opposite end portions of the substrate.

10. An image display device according to claim 9, wherein said mounting means at each of said opposite end portions comprises an array of through holes, said positioning pins extending through said through holes, respectively.

11. An image display device according to claim 9, wherein said mounting means at each of said opposite end portions comprise a support bar fixed to said substrate, said support bar having an array of through holes defined therein, and said positioning pins extending through said through holes, respectively.

* * * * *